US009829852B2

(12) United States Patent
Hiramatsu et al.

(10) Patent No.: US 9,829,852 B2
(45) Date of Patent: Nov. 28, 2017

(54) IMAGE FORMING APPARATUS HAVING CLEANING MEMBER THAT COLLECTS DEVELOPING AGENT ADHERING TO PHOTOCONDUCTIVE MEMBER AFTER IMAGE TRANSFER

(71) Applicant: Brother Kogyo Kabushiki Kaisha, Nagoya-shi, Aichi-ken (JP)

(72) Inventors: Hiroshige Hiramatsu, Inuyama (JP); Aya Adachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/254,389

(22) Filed: Apr. 16, 2014

(65) Prior Publication Data

US 2014/0314430 A1 Oct. 23, 2014

(30) Foreign Application Priority Data

Apr. 17, 2013 (JP) ..... 2013-086277

(51) Int. Cl.
*G03G 21/00* (2006.01)
*G03G 15/00* (2006.01)

(52) U.S. Cl.
CPC ..... *G03G 21/0023* (2013.01); *G03G 15/5033* (2013.01); *G03G 15/5037* (2013.01); *G03G 21/0005* (2013.01); *G03G 21/0035* (2013.01)

(58) Field of Classification Search
CPC ..... G03G 15/5033; G03G 15/5037; G03G 21/0005; G03G 21/0035; G03G 2215/0073; G03G 21/0023
(Continued)

(56) References Cited

U.S. PATENT DOCUMENTS 7,120,366 B2 * 10/2006 Onodera ..... G03G 21/105 399/123
2002/0009316 A1 * 1/2002 Endo ..... G03G 21/0005 399/349
(Continued)

FOREIGN PATENT DOCUMENTS

JP H08-095453 A 4/1996
JP H08-123274 A 5/1996
(Continued)

OTHER PUBLICATIONS

Dec. 27, 2016—(JP) Notification of Reasons for Rejection—App 2013-086277, Eng Tran.

*Primary Examiner* — Joseph S Wong
(74) *Attorney, Agent, or Firm* — Banner & Witcoff, Ltd.

(57) ABSTRACT

An image forming apparatus has a photoconductive member and a cleaning member arranged to face the photoconductive member at a cleaning position and configured to be applied with a cleaning bias to collect residual developing agent on the photoconductive member after the developed image is transferred. A controller of the image forming apparatus controls a transferring bias so that a transferring current representing a current flowing between the photoconductive member and a transferring member is controlled to become a target current value. Further, the controller calculates a cleaning position potential representing a surface potential of the photoconductive member at the facing position based on the transferring current and a charge potential representing a surface potential of the photoconductive member immediately after being charged by the charging device, and controls the cleaning bias based on the cleaning position potential as calculated.

9 Claims, 4 Drawing Sheets

(58) Field of Classification Search
USPC ..... 399/44, 71, 354
See application file for complete search history.

(56) References Cited

U.S. PATENT DOCUMENTS

| | | | | |
|---|---|---|---|---|
| 2010/0080584 | A1* | 4/2010 | Booth | G03G 15/0131 399/44 |
| 2010/0247190 | A1* | 9/2010 | Shirai | G03G 21/0047 399/350 |
| 2011/0299866 | A1 | 12/2011 | Kadota et al. | |

FOREIGN PATENT DOCUMENTS

| | | | |
|---|---|---|---|
| JP | H08-179594 | A | 7/1996 |
| JP | H10-104967 | A | 4/1998 |
| JP | 2003-330285 | A | 11/2003 |
| JP | 2005-331875 | A | 12/2005 |
| JP | 2012-014145 | A | 1/2012 |

* cited by examiner

| TEMPERATURE | CHARGING BIAS |
|---|---|
| T10 | B850 |
| T20 | B800 |
| T30 | B750 |
| T40 | B700 |

FIG. 3

| SHEET SIZE | TARGET CURRENT |
|---|---|
| POSTCARD | I14 |
| A5 | I13 |
| B5 | I12 |
| A4 | I11 |

FIG. 4

| HUMIDITY | TARGET CURRENT |
|---|---|
| H40 | I24 |
| H50 | I23 |
| H60 | I22 |
| H70 | I21 |

FIG. 5

IMAGE FORMING APPARATUS HAVING CLEANING MEMBER THAT COLLECTS DEVELOPING AGENT ADHERING TO PHOTOCONDUCTIVE MEMBER AFTER IMAGE TRANSFER

CROSS-REFERENCE TO RELATED APPLICATION

This application claims priority under 35 U.S.C. §119 from Japanese Patent Applications No. 2013-086277 filed on Apr. 17, 2013. The entire subject matter of the application is incorporated herein by reference.

BACKGROUND

Technical Field

Aspects of the present invention relate to an image forming apparatus which is provided with a cleaning member configured to collect developing agent adhered on a photoconductive member after image transferring is executed.

Conventional Art

Conventionally, an image forming apparatus having a photoconductive member, a charging device configured to charge the surface of the photoconductive member, an exposing device configured to emit light to expose the surface of the charged surface of the photoconductive member to form an electrostatic latent image thereon, a developing device configured to apply toner onto the surface of the photoconductive member to develop the electrostatic latent image (i.e., to form a toner image), and a transferring device configured to transfer the toner image on a printing sheet. Such an image forming apparatus is typically provided with a cleaning member configured to remove and collect the residual toner which is retained on the surface of the photoconductive member after the toner image is transferred to the printing sheet. The cleaning member is, for example, a conductive brush roller, and a surface electrical potential of such a conductive brush roller is maintained at a predetermined potential during an image forming process, thereby the residual toner is collected from the photoconductive member.

SUMMARY

In the image forming apparatus as described above, a constant current control of a transfer bias, which is applied to a transferring roller of the transferring device, is typically executed such that the quantity of the electrical current flowing between the photoconductive member and the transferring roller (which will be referred to as a transferring current hereinafter) is maintained to be a predetermined target current.

In order to maintain image quality, the target current is varied depending on the humidity inside the image forming apparatus, the size of the printing sheet and the like. Further, a charging bias applied to the charging device is varied depending on the temperature inside the image forming apparatus and the like to maintain a surface electrical potential of the photoconductive member at a necessary level.

When the transferring current and/or the charging bias are changed, the surface potential of the photoconductive member after transfer may change. In such a case, in the conventional image forming apparatus as described above, a potential difference between the surface potential of the photoconductive member and the surface potential of the cleaning member also changes since the surface potential of the cleaning member is constant, and a certain cleaning capability may not be maintained.

In consideration of the above defects, aspects of the present invention provide an image forming apparatus which is capable of providing sufficient cleaning capability of the cleaning member.

According to aspects of the invention, there is provided an image forming apparatus, which is provided with a photoconductive member, a charging device configured to apply a charging bias to the photoconductive member to charge a surface of the photoconductive member, an exposing device configured to expose the surface of the photoconductive member to light to form an electrostatic latent image on the surface of the photoconductive member, a developing device configured to supply developing agent onto the electrostatic latent image on the photoconductive member to form a developed image, a transferring member configured to be applied with a transferring bias, the transferring member configured to transfer the developed image on the photoconductive member on a sheet by the transferring bias between the photoconductive member and the transferring member, a cleaning member arranged to contact the photoconductive member at a cleaning position, the cleaning member being configured to be applied with a cleaning bias to collect the developing agent residual on the photoconductive member after the developed image is transferred, and a controller configured to control the charging bias, the transferring bias and the cleaning bias.

The controller is configured to control the transferring bias so that a transferring current representing a current flowing between the photoconductive member and the transferring member is controlled to become a target current value. Further, the controller is configured to calculate a cleaning position potential representing a surface potential of the photoconductive member at the facing position based on the transferring current and a charge potential representing a surface potential of the photoconductive member immediately after charged by the charging device, and controls the cleaning bias based on the cleaning position potential as calculated.

According to the above configuration, the cleaning bias is controlled based on the calculated cleaning position potential. Therefore, a sufficient potential between the photoconductive member and the cleaning member at the facing position is ensured, and an improved cleaning performance can be obtained.

BRIEF DESCRIPTION OF ACCOMPANYING DRAWINGS

FIG. 1 schematically shows a cross-sectional view of a color printer according to an embodiment of the invention.

FIG. 3 is an exemplary table used to control a charging bias according to the embodiment of the invention.

FIG. 4 is an exemplary table used to control a target current according to the embodiment of the invention.

FIG. 5 is another exemplary table used to control a target current according to the embodiment of the invention.

DETAILED DESCRIPTION OF THE EMBODIMENT

Figure 1:
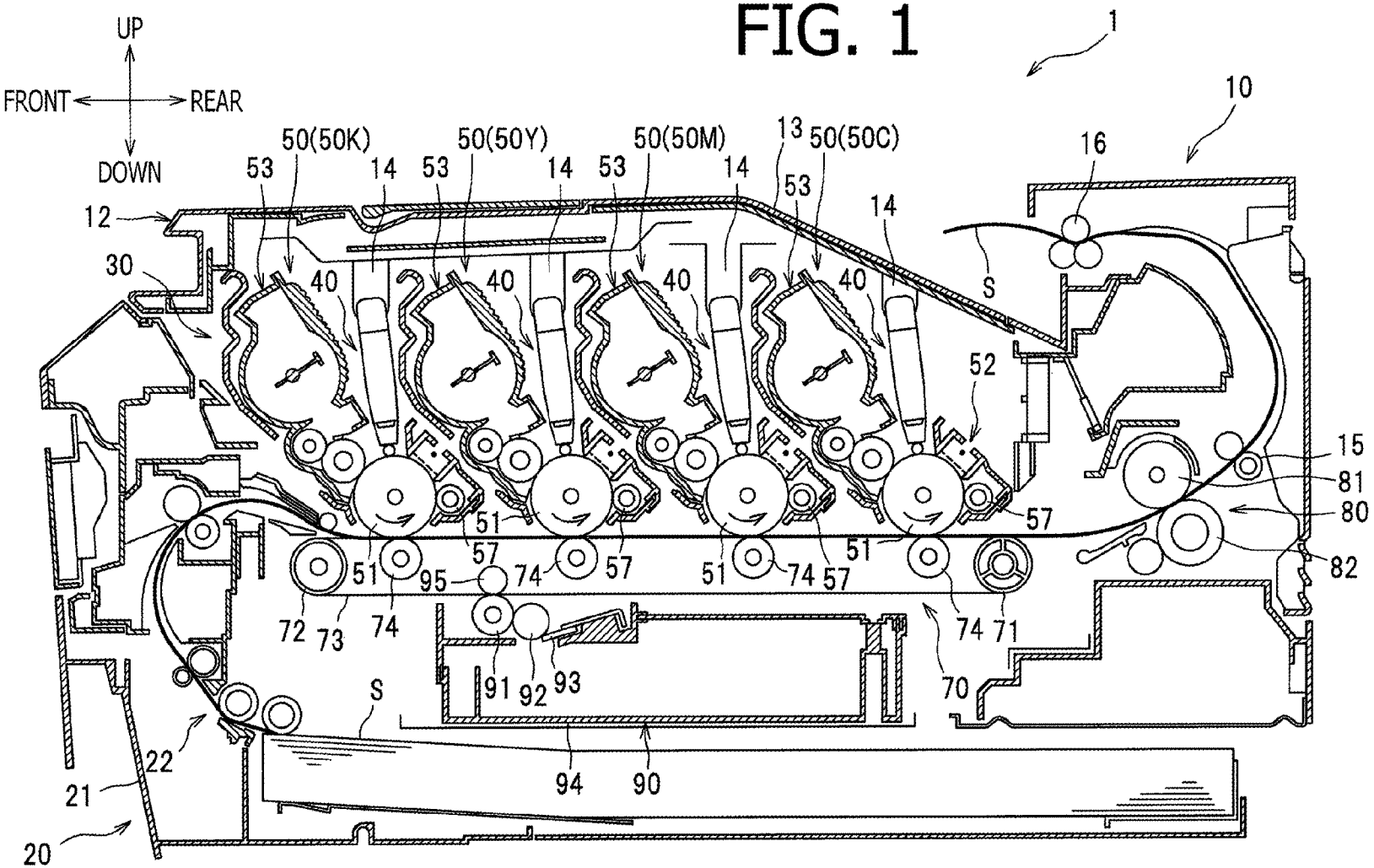

Hereinafter, an embodiment according to the present invention will be described with reference to the accompanying drawings. In the following description, outline configuration and operation of a color printer 1 according to the embodiment will be described, followed by a detailed description regarding characteristic features of the color printer 1. It is noted that, in the following description, directions are indicated with respect to those of a user of the color printer 1. Specifically, a left-hand side, which is a side closer to the user, of the color printer 1 shown in FIG. 1 will be referred to as a front side, and a right-hand side, which is a farther side from the user, of the color printer 1 shown in FIG. 1 will be referred to as a rear side. Further, a front side with respect to a plane of FIG. 1 will be referred to as a right side of the color printer 1, and a far side with respect to a plane of FIG. 1 will be referred to as a left side of the color printer 1. Up and down sides of FIG. 1 are up and down sides of the color printer 1, respectively.

<Outline Configuration of Color Printer>

The color printer 1 has a housing 10, in which a sheet conveying unit 20, an image forming unit 30, a collecting unit 90 are provided. On an upper side of the housing 10, an upper cover 12 is provided. The upper cover 12 is configured to rotate about an axis defined at a rear end portion thereof such that a front side portion of the upper cover 12 is movable in an up-and-down direction.

The sheet conveying unit 20 is arranged at a lower portion of the housing 10, and includes a sheet tray 21 containing printing sheets S, and a sheet conveying mechanism 22. Each of the sheet S contained in the sheet tray 21 is separated and supplied one by one by the sheet conveying mechanism 22, toward the image forming unit 30.

The image forming unit 30 has four exposing units 40, four process cartridges, a transferring unit 60 and a fixing unit 80.

The exposing units 40 are arranged above the photoconductive drums 51, respectively, to face each other. Each of the exposing units 40 has an exposing head which has a plurality of LED's (light emitting diodes) arrayed in the right-and-left direction (i.e., a direction perpendicular to the plane of FIG. 1). Since such a type of exposing head is well-known, detailed description thereof will not be provided for brevity. The LED's of each exposing head are turned ON/OFF individually in accordance with image data, thereby a circumferential surface of each photoconductive drum 51, which has been uniformly charged, is exposed to the light, thereby an electrostatic latent image being formed on the circumferential surface of each photoconductive drum 51. Further, the four exposing units 40 are supported by the upper cover 12 via the holding units 14, respectively. When the upper cover 12 is opened, the exposing units 40 are moved away from the respective photoconductive drums 51.

There are four process cartridges 50 which include a black toner cartridge 50K, a yellow toner cartridge 50Y, a magenta toner cartridge 50M and a cyan toner cartridge 50C, which are arranged in this order from the front to rear. The four process cartridges 50 (i.e., 50K, 50Y, 50M and 50C) are detachable from the housing 10 when the upper cover 12 is opened. Each of the process cartridges 50 (i.e., 50K, 50Y, 50M and 50C) includes the photoconductive drum 51, a charging device 52, a developing device 53 and a cleaning member 57. According to the embodiment, the cleaning member 57 is a cleaning roller 57.

Each of the four photoconductive drums 51 has a hollow-cylindrical conductive drum body provided with a photosensitive layer formed on the circumferential surface of the drum body and a rotation shaft conductively connected to the drum body, which is grounded. Each of the photoconductive drums 50 is configured to rotate about the shaft in a direction indicated by an arrow in FIG. 1.

The charging devices 52 are well-known scorotron type charging devices, each having a corona wire and a grid electrode. The charging devices 52 are arranged at upper rear positions with respect to the photoconductive drums 51 to face the same, respectively. The charging devices 52 are configured to charge the surface of the photoconductive drums 51 as charging biases are applied thereto, respectively.

Each of the developing devices 53 has a well-known structure having a developing roller, a toner thickness regulating blade, and a toner container accommodating toner which has positive charging characteristic. The developing devices 53 are arranged at upper front portions with respect to the photoconductive drums 51 to face the same, respectively. The developing devices 53 are configured to supply toner on images formed on the photoconductive drums 51 to form toner images (i.e., developed images) thereon, respectively.

Each of the cleaning roller 53 is configured such that a shaft made of metal is coated with a roller body made of electrically-conductive elastic foam member. The cleaning rollers 53 are arranged on rear side of the photoconductive drums 51 to face the same, respectively. The cleaning rollers 57 are configured to remove and collect toner adhered on the photoconductive drums 51 after the toner images are transferred as cleaning biases are applied The transferring device 70 is arranged between the sheet conveying unit 20 and the process cartridges 50, and has a driving roller 71, a driven roller 72, conveying belt 73 and four transferring rollers 74. The conveying belt 73 is wound around the driving roller 71 and the driven roller 72. Above the outer surface of the conveying belt 74, the four photoconductive drums 51 are arranged to face the conveying belt 73. The four transferring rollers 74 are respectively arranged below the four photoconductive drum 50 with the conveying belt 73 located therebetween. As the transfer bias is applied to each of the conveying rollers 74, a toner image formed on each photoconductive drum 51 is transferred onto the sheet S which is conveyed between each of the photoconductive drums 51 and conveying belt 73.

The fixing device 80 is arranged on the rear side with respect to the process cartridges 50 and the transferring device 70. The fixing device 80 has a heat roller 81 and a pressure roller 82 which is arranged to face the heat roller 81 and urged toward the heat roller 81.

The collecting unit 90 is arranged below the conveying belt 73, and has a first collecting roller 91, a second collecting roller 92, a scraping blade 93, a toner container 94 and a back-up roller 95. The conveying belt 73 is held at a nip between the first collecting roller 91 and the back-up roller 95. The collecting unit 90 is configured to remove and collect the toner adhered on the conveying belt 73 in the toner container 94.

<Operation of Color Printer>

When a print job, which contains image data and command to form an image, is transmitted from an external device such as a personal computer, the color printer 1 executes a printing operation to form (i.e., print) an image on the sheet S. Specifically, during the printing operation, the circumferential surfaces of photoconductive drums 51 driven to rotate are positively charged by the charging devices 52 and exposed to light emitted by the exposing devices 40, respectively, thereby electrostatic latent images being formed, based on the image data, on each of the photoconductive drums 51. Thereafter, as the toner is supplied from the developing devices 53, the electrostatic latent images formed on the photoconductive drums 51 are visualized (i.e., developed) as the toner images.

During the above operation, the sheet conveying mechanism 22 conveys the sheet S accommodated in the sheet tray 21 to the image forming unit 30 at a suitable timings. As the sheet S is conveyed between the photoconductive drums 51 and the transferring rollers 74 which are applied with the transferring biases as conveyed by the belt 73, the toner images on the photoconductive drums 51 are transferred on the sheet S.

After the toner images are transferred, the sheet S is conveyed through the nip between the heat roller 81 and the pressure roller 82, thereby the toner images are fixed on the sheet S as the heat and pressure are applied. The sheet S bearing the fixed image is then discharged from the housing 10 by the conveying roller 15 and the discharging roller 16, and placed on a discharge tray 13. The toner resides on the circumferential surfaces of the photoconductive drums 51 after the toner images have been transferred are collected by and on the cleaning rollers 57, to which the cleaning biases are applied.

After the printing operation has been finished, the color printer 1 executes a collecting operation to collect the toner adhered on the cleaning rollers 57, the photoconductive drums 51 and the conveying belt 73 in the toner collecting unit 90. Specifically, in the collecting operation, the toner adhered on the cleaning rollers 57 is moved onto the circumferential surfaces of the photoconductive rollers 51, and then moved onto the conveying belt 73. The toner adhered on the conveying belt 73 is collected by the collecting unit 90. After the collecting operation described above has been executed for a predetermined period, the color printer 1 operates in a stand-by mode and waits for input of a next print job.

It is noted that the collecting operation may be executed every time when a printing operation is finished (i.e., when an input print job has been finished). Alternatively, the collection operation may be executed at every predetermined timing (e.g., when the color printer 1 is powered on, when the upper cover 12 is closed, when the number of printed sheets S becomes a predetermined number, when the number of dots formed on the printing sheets S reaches a predetermined number, and the like.).

<Detailed Configuration of Color Printer>

Figure 2:
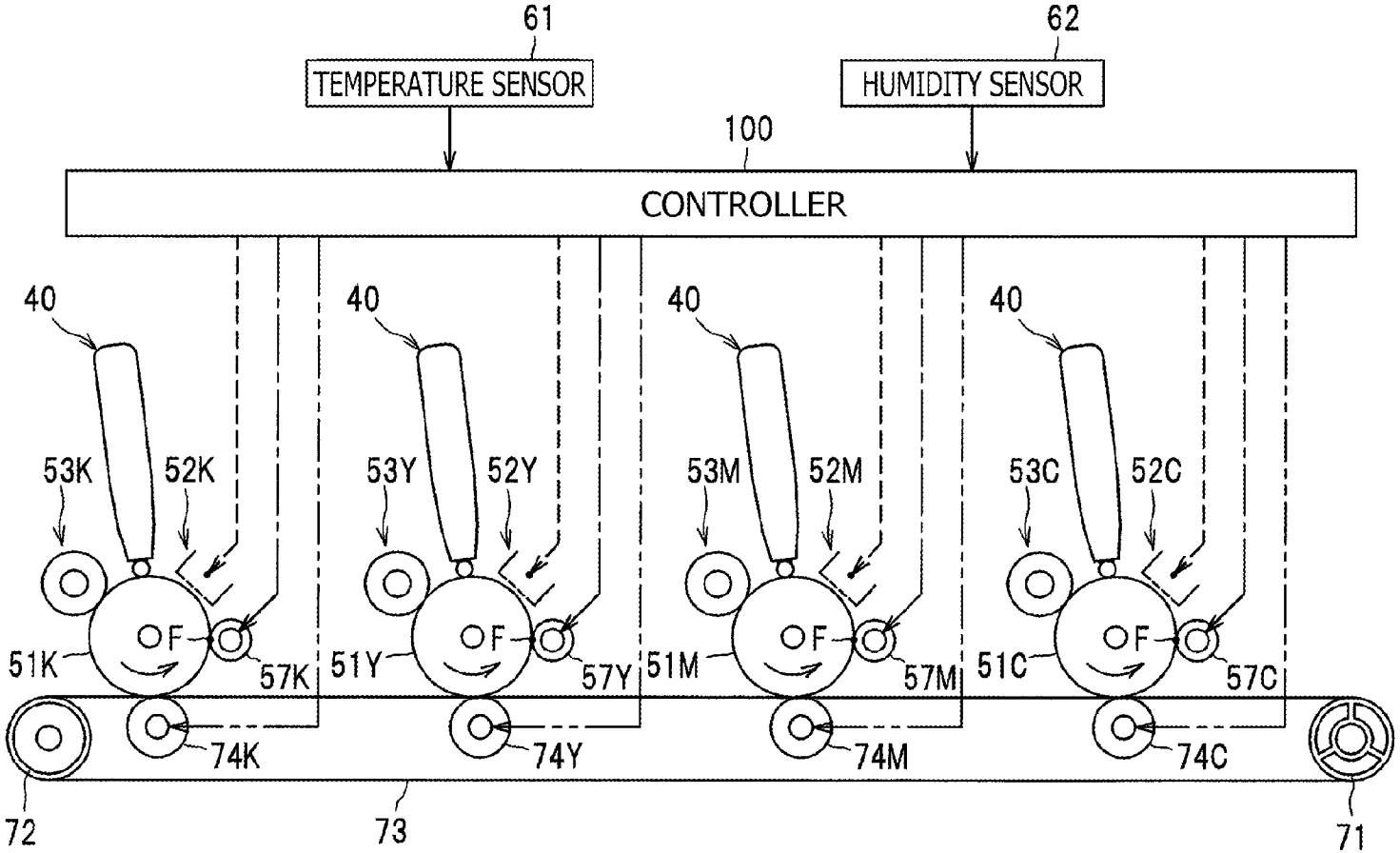
FIG. 2 shows characteristic features of the color printer shown in FIG. 1.

The color printer 1 has the exposing devices 40, the photoconductive drums 51, the charging devices 52, the developing devices 53 (only the photoconductive drums being depicted in FIG. 2), the cleaning rollers 57, the transferring rollers 74, a temperature sensor 61, which is configured to detects In the following description, when the photoconductive drums 51, developing devices 52 and the like are referred to in relation to the colors of the toner (i.e., black, yellow, magenta and cyan), letters K, Y, M and C are suffixed to the reference numbers, respectively.

The controller 100 has a well-known configuration and has a CPU (central processing unit), a RAM (random access memory), a ROM (read only memory), and an I/O (input/output) interface. The controller executes programs and control operations of respective components of the color printer 1, thereby the entire operation being controlled by the controller 100.

According to the embodiment, the controller 100 controls the color printer 1 to operate in a first mode (i.e., a color print mode) or in a second mode (i.e., a black and white print mode) based on the type of the input image data, user's selection and the like. When the color printer 1 operates in the first mode, toner images are formed on all the photoconductive drums 51 and overlaid on the sheet S sequentially, thereby a color image is formed on the sheet S. When the color printer 1 operates in the second mode, a toner image is formed only on the photoconductive drum 51K and transferred on the sheet S. According to the embodiment, the developing devices 53Y, 53M and 53C are spaced from the photoconductive drums 51Y, 51M and 51C, respectively. Since such a configuration is well-known, detailed description thereon will not be made for brevity.

The controller 100 is configured to control the charging bias to be applied to each of the charging devices 52, the transferring bias applied to each of the transferring rollers 74 and the cleaning bias applied to each of the cleaning rollers 57, during the printing operation.

The charging bias is a positive bias applied to each charging device 52 to control a surface electrical potential (hereinafter, referred to as a charge potential) of each photoconductive drum 51 immediately after charging. According to the embodiment, the controller 100 controls the charging bias to be applied to each charging device 52 based on a predetermined table, formula, or the like.

Further, the controller 100 is configured to vary the charging bias to be applied to each charging device 52 in accordance with an operation environment, printing mode and the like.

Specifically, the controller 100 is configured such that, when the temperature inside the housing 10, which is detected by the temperature sensor 61, is relatively low, the charging bias to be applied to the charging devices 52 is increased in comparison with a case where the temperature inside the housing 10 is relatively high.

For example, when the temperature inside the housing 10 is equal to or smaller than a predetermined threshold temperature (e.g., 10° C.), the charging bias applied to each charging device 52 is higher than the charging bias when the temperature inside the housing 10 is higher than the threshold temperature.

For another example, a table showing a relationship between the temperature inside the housing 10 and the charging bias (see FIG. 3) may be stored in the ROM of the controller, and the controller 100 determines the amount of the charging bias based on the temperature inside the housing 10 based on the table. It is noted that, in the table showing in FIG. 3, T10<T20<T30<T40, and B850>B800>B750>B700. According to this example, when the temperature inside the housing 10 is T10, the charging bias of B850 is applied to the charging devices 52. It is noted that, in the table 3, indication of T10 (T20, T30, T40) may represent a single value (e.g., 10° C.) or a range of values (e.g., 0° C.-20° C.).

Further, according to the embodiment, when the color printer 1 operates in the black and white printing mode, the charging bias applied to the charging devices 52Y, 52M and 5C, which correspond to the photoconductive drums 51Y, 51M and 51C, is set to a smaller value than a case where the color printer 1 operates in the color print mode.

For example, when the color printer 1 operates in the color print mode, the controller 100 sets the charging bias to 700 volts which is applied to all the charging devices 52, while the charging bias applied to the charging devices 52Y, 52M and 52C is set to 400 volts when the color printer 1 operates in the black and white print mode. It is noted that the charging bias is applied to the charging devices 52Y, 52M and 52C when the color printer 1 operates in the black and white print mode mainly because, by keeping the charging potential of the photoconductive drums 51Y, 51M and 51C to a predetermined amount, the black toner transferred but not fixed on the sheet S is prevented from being attracted by the photoconductive drum 51Y, 51M and 51C.

The transferring bias is a negative bias applied to each transferring roller 74. The transferring rollers 74 applied with the transferring bias attract the toner (i.e., toner images), which are formed in the developing operation is executed, on the photoconductive drums 51 toward the transferring rollers 74. Specifically, the controller 100 executes a constant current control so that an electrical current (hereinafter, referred to as a transfer current), which flows between each photoconductive drum 51 and the corresponding transferring roller 74, has a target value within a predetermined unit area of each photoconductive drum 51.

Additionally, according to the embodiment, the controller 100 is configured to change the target current value based on predetermined tables, formulae and the like, depending on the operation environment of the color printer 1, the size of the sheet S and the like.

Specifically, when the length of the sheet S in the width direction (i.e., the right-and-left direction) is relatively short, in order to ensure a sufficient current flows between each of the photoconductive drums 51 and the transferring rollers 74 via the sheet S, the controller 100 controls the transferring bias by setting the target current to have a larger value in comparison with a case where the length of the sheet S in the width direction is relatively long.

For example, when the size of the sheet S is equal to or less than a predetermined size (e.g., a postcard size), the controller 100 sets a larger value to the target current in comparison with a case where the size of the sheet S is larger than the predetermined size. Alternatively, the controller 100 sets the target value based on a table as shown in FIG. 4. In FIG. 4, I14>I13>I12>I11. According to this table, when the size of the sheet S is the postcard size, current I14 is set as the target current.

When the humidity inside the housing 10, i.e., the humidity detected by the humidity sensor 62, is relatively high, the resistance of the sheet S is relatively high and the current flows less smoothly, the controller 100 changes the target current to a higher current than a case where the humidity is relatively low to ensure the necessary transferring bias. For example, when the humidity inside the housing 10 is equal to or less than a predetermined threshold value (e.g., 50%), the controller 100 sets a higher value to the target current in comparison with a case where the humidity inside the housing 10 is higher than the predetermined threshold value. For another example, the controller 100 determines the target current with reference to a table shown in FIG. 5, which shows a relationship between the humidity inside the housing 10 and the target current. It is noted that, in the table shown in FIG. 5, H40<H50<H60<H70 and I24>I23>I22>I21. According to this table, when the humidity inside the housing 10 is H50, the controller 100 determines the target value as I23. It is noted that, in the table shown in FIG. 5, the humidity H50 (H60, H70, H80) may represent a single value (e.g., 50%) or a range (e.g., 40%-60%).

The cleaning bias is a negative bias applied to each cleaning roller 57 so that the residual toner, which remains on the photoconductive drums 51 after transferring the toner images, is attracted by the cleaning rollers 57. The controller 100 controls the amount of the cleaning bias to be applied to the cleaning rollers 57 in accordance with the transfer potential, which is a surface potential of each photoconductive drum 51, and the transfer current which is a current flowing between each of the photoconductive drums 51 and the respective transfer rollers 74.

According to the embodiment, the controller 100 calculates a surface potential Pcln (hereinafter, referred to as a cleaning position potential Pcln) of the photoconductive drum 51 at a position F at which each of the photoconductive drums 51 faces the cleaning roller 57 in accordance with a formula (1) below, based on the charge potential Vch and the transfer current Itr.

$$Pcln=k1\times Vch-k2\times Itr \quad (1)$$

where, k1 and k2 are compensation values, which will be described in detail below.

Next, the controller 100 calculates the cleaning bias Vcln to be applied to each cleaning roller 57 based on the cleaning position potential Pcln in accordance with a formula (2) below.

$$Vcln=Pcln-D \quad (2)$$

where D is a constant representing a difference in potential between the cleaning position potential Pcln and the cleaning bias Vcln.

In the above formula (1), the charge potential Vch is an estimate value of the surface potential of the photoconductive drum 51 when the photoconductive drum 51 is charged by the charging device 52 which is applied with the charging bias having the predetermined value. Therefore, the charge potential Vch can be obtained based on the charging bias which is applied to the charging device 52, a predetermined table and formulae and the like.

In the formula (1), k1 is a compensation value which is used to compensate for the charge potential Vch based on a degree of deterioration of the photoconductive drum 51. The photoconductive drum 51 deteriorates indispensably with time. Specifically, since a charging performance of the photoconductive drum 51 deteriorates with time, even if the same charging bias is applied to the charging device 52 to charge the photoconductive drum 51, and if the charging device has been used relatively long time, the charge potential may be lowered. Therefore, when the controller 100 controls the cleaning position potential Pcln, the charge potential Vch is multiplied by the compensation value k1. Since the deterioration of the photoconductive drum 51 proceeds with time, the compensation value k1 is determined in accordance with an elapse of a used time since the photoconductive drum 51 was exchanged, with referring to a table or formulae. For example, the compensation value k1 may be changed to have a value 1, 1.05, 1.1 . . . in accordance with elapse of the used time.

The transfer current Itr represent a current flowing through a portion at which the photoconductive drum 51 and the transferring roller 74 via the sheet S and the belt 73 when the toner image is transferred to the sheet S. The transfer current Itr may be measured, or the target current which is set when the transferring bias is controlled may be used as the transfer current Itr.

The compensation value k2 is used to compensate for the transfer current Itr based on an electric characteristic (e.g., charging performance) of the photoconductive drum 51. The electric characteristics of the photoconductive drums may vary indispensably depending on lot and manufacturer. Therefore, when the controller 100 controls the cleaning bias, the transfer current Itr, which is used to calculate the cleaning position potential Pcln, is multiplied by the compensation value k2. The compensation value k2 is a predetermined coefficient determined based on the lot and/or manufacturer in advance.

In the formula (2), D represents a constant used to calculate the cleaning bias Vcln from the cleaning position potential Pcln. In other words, between the photoconductive drum 51 having the cleaning position potential Pcln and the cleaning roller 57 applied with the cleaning bias Vcln, a potential difference D (i.e., Pcln−Vcln) is being applied. Thus, according to the embodiment, the controller 100 controls the cleaning bias such that the difference in potentials of the photoconductive drum 51 and the cleaning roller 57 at the facing position F is included in a predetermined range (i.e., the potential difference becomes D).

For example, when the charging potential Vch is 700 V, the transferring current Itr is 10 μA, the compensation coefficient k1 is one, the compensation coefficient k2 is 50 V/μA, and the constant D is 500 V, the cleaning position potential Pcln is calculated based on the formula (1), and the cleaning bias Vcln is calculated based on the formula (2) as indicated below.

$$Pcln=1\times700-50\times10=200\ (V),\ \text{and}$$

$$Vcln=200-500=-300\ (V).$$

In another example, when the charging potential Vch is 850 V, the transferring current Itr is 14 μA, the compensation coefficient k1 is one, the compensation coefficient k2 is 40 V/μA, and the constant D is 500 V, the cleaning position potential Pcln is calculated based on the formula (1), and the cleaning bias Vcln is calculated based on the formula (2) as indicated below.

$$Pcln=1\times850-40\times14=290\ (V),\ \text{and}$$

$$Vcln=290-500=-210\ (V).$$

Figure 6A:
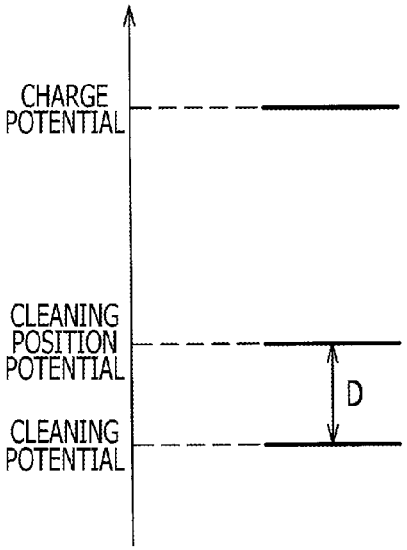
FIGS. 6A and 6B show effects of the color printer according to the embodiment of the invention.
Figure 6B:
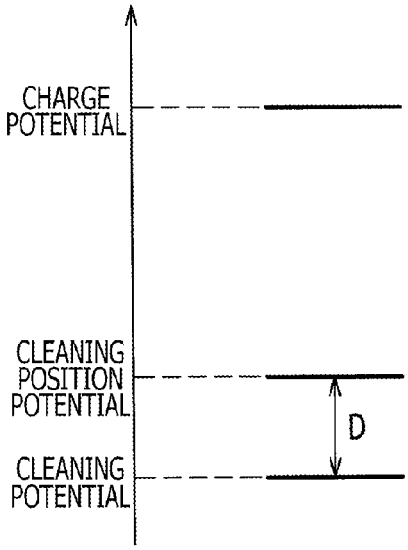
Figure 6C:
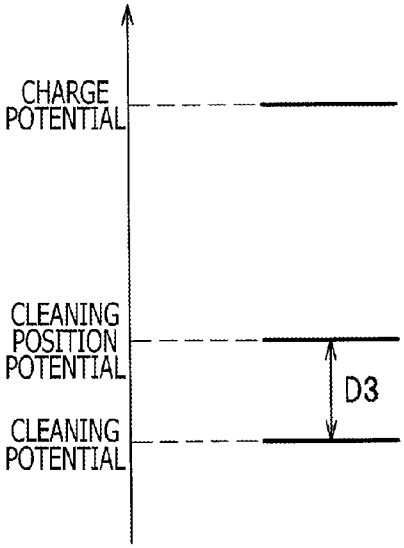
FIG. 6C PRIOR ART
FIGS. 6C and 6D show effects of the color printer according to the conventional color printer.
Figure 6D:
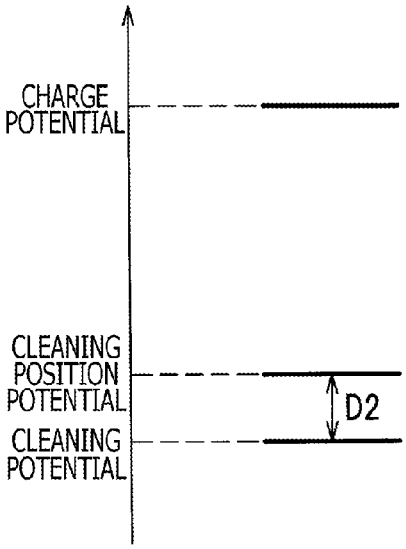
FIG. 6D PRIOR ART

As shown in FIGS. 6C and 6D, in a conventional configuration, the surface potential of the cleaning roller (hereinafter, referred to as a cleaning potential) is constant. If the transferring current increases and the cleaning position potential is lowered, the difference between the cleaning position potential and the cleaning potential is reduced from D3 to D2 as respectively shown in FIGS. 6C and 6D. If the potential is reduced to D2, the toner adhered on the photoconductive drum becomes less movable to the cleaning roller. Thus, according to the conventional configuration, the cleaning performance may be lowered.

In contrast, according to the embodiment shown in FIGS. 6A and 6B, the cleaning bias is controlled based on the cleaning position potential which is calculated from the charge potential and the transferring current. Therefore, for example, even if the transferring current increase and the cleaning position potential is lowered, a sufficient difference between the cleaning position potential (of the photoconductive drum 51) and the cleaning potential (of the cleaning roller 57) can be maintained. Accordingly, the cleaning performance of the cleaning roller 57 can be ensured.

In particular, according to the embodiment, the cleaning bias is controlled so that the difference in potential between each of the photoconductive drums 51 and the corresponding cleaning roller 57 is substantially constant (i.e., D), the cleaning performance of the cleaning rollers 57 is ensured.

According to the embodiment, when the cleaning bias is controlled, the charge potential and the transferring current, which are used to calculate the cleaning position potential, are compensated based on the degree of deterioration and/or the electrical performance of the photoconductive drum 51, the cleaning bias can be controlled precisely, and the cleaning performance of the cleaning rollers 57 can be improved.

It should be noted that the invention need not be limited to the configuration of the exemplary embodiment described above. Various modifications can be made without departing from the scope of the invention.

In the exemplary embodiment, D in the formula (2) is defined as a constant. However, this configuration may be modified such that D in the formula (2) can be variable.

In the exemplary embodiment, the controller 100 controls the cleaning bias Vcln based on the cleaning position potential Pcln calculated using the formula (1), and based on the formula (2). This can be modified such that the controller may control the cleaning bias based on the calculated cleaning position potential and a table defining, in advance, a relationship between the cleaning position potential and the cleaning bias.

In the exemplary embodiment, the controller 100 compensates for only the transferring current based on the electrical characteristic of the photoconductive drum 51 when the cleaning bias is controlled. The above configuration may be modified such that the controller compensates for only the charge potential based on the electrical characteristic of the photoconductive drum when the cleaning bias is controlled, or both the transferring current and the charge potential may be compensated based on the electrical characteristic of the photoconductive drum.

It is noted that, in the present invention, the compensation for the charge potential and/or the transferring current is not necessarily introduced. For example, if the charge performance of the photoconductive drum will not be considerably deteriorated within its usable life, it may not be necessary to compensate for the charge potential.

According to the exemplary embodiment, the color printer 1 has a collecting unit 90, and the collecting operation is executed after the printing operation is completed. This can be modified as explained below. For example, the color printer 1 may not be provided with the collecting unit 90, and may be configured such that the toner collected by the cleaning rollers 57 may be stored inside the process cartridges 50.

In the exemplary embodiment, the exposing unit 40 is configured such that the photoconductive drum is exposed as the LED's of the exposing unit 40 are ON/OFF controlled. This configuration may be modified such that the exposing unit may be a scanning optical device configured to emit a laser beam scanning at a high speed.

In the exemplary embodiment, for the four photoconductive drums 51, four exposing units 40 are provided, respectively. The configuration may be modified such that, if an exposing device is capable of emitting a plurality of (e.g., four) laser beams, only one exposing device may be sufficient.

In the exemplary embodiment, the charging device 52 is a scorotron type charging device. This configuration can be modified and the charging device may be of a corotron type.

The charging device according to the exemplary embodiment employs corona wires. Alternatively, charging devices may be pin array chargers having aligned needle electrodes.

In the exemplary embodiment, the cleaning roller 57 is configured such that a metallic shaft is covered with a cylindrical roller body made of foam elastic conductive member. The invention needs not be limited to such a configuration. For example, the cleaning member may be a brush roller having a layer of conductive fibers on its circumferential surface.

In the exemplary embodiment, the photoconductive drums 51 are employed as photoconductive members. The invention needs not be limited to such a configuration, and photoconductive belts may be employed instead of the photoconductive drums.

In the exemplary embodiment, the transferring rollers 74 are employed. The invention needs not be limited to such a configuration and a belt-type transferring member may be employed instead of the transferring roller.

The configuration of the developing devices 53 is only an exemplary one, and the invention needs not be limited to such a configuration. For example, the developing device may be configured such that a toner container is detachably attached to a frame that supports a developing roller and a supply roller.

In the exemplary embodiment, as the image forming apparatus, the color printer 1 is described. Specifically, the color printer 1 has a plurality of photoconductive members, a plurality of charging devices, and a plurality of transferring members. The invention needs not be limited to such a configuration, and the image forming apparatus may be a printer which prints only a black and white image, and has a single photoconductive member, a single charging device and a single transferring member.

Further, the image forming apparatus needs not be limited to printers. That is, the image forming apparatus may be a copying machine or an MFP (multi function peripheral) having an original scanning device such as a flatbed scanner.

In the exemplary embodiment, the image forming apparatus uses positively-charged toner. The invention needs not be limited to such a configuration, and the invention can also be applied to an image forming apparatus using negatively-charged tonner. In this case, the positive/negative relationship in the description should be reversed and high/low of the biases in the description should be interpreted as the high/low of "absolute values" of the biases.

What is claimed is:

1. An image forming apparatus, comprising:

a photoconductive member;

a charging device configured to apply a charging bias to the photoconductive member to charge a surface of the photoconductive member;

an exposing device configured to expose the surface of the photoconductive member to light to form an electrostatic latent image on the surface of the photoconductive member;

a developing device configured to supply developing agent onto the electrostatic latent image on the photoconductive member to form a developed image;

a transferring member configured to be applied with a transferring bias, the transferring member configured to transfer the developed image on the photoconductive member onto a sheet by the transferring bias between the photoconductive member and the transferring member;

a cleaning roller arranged to contact the photoconductive member at a cleaning position, the cleaning roller being configured to be applied with a cleaning bias to collect residual developing agent on the photoconductive member after the developed image is transferred, and the cleaning roller configured to attract the residual developing agent by the cleaning bias; and a controller configured to control the charging bias, the transferring bias and the cleaning bias, wherein the controller is configured to control the transferring bias so that a transferring current (Itr) representing a current flowing between the photoconductive member and the transferring member is controlled to become a target current, wherein the controller is configured to calculate a cleaning position potential (Pcln) representing a surface potential of the photoconductive member at the cleaning position based on the transferring current and a charge potential (Vch) representing a surface potential of the photoconductive member immediately after being charged by the charging device, and control the cleaning bias based on the cleaning position potential as calculated so that the cleaning bias and the cleaning position potential have a predetermined potential difference other than zero, and wherein a value of the cleaning position potential (Pcln) is obtained by subtracting the transferring current (Itr) multiplied by a first compensation coefficient (k2) based on an electric characteristic of the photoconductive member from the charge potential (Vch) multiplied by a second compensation coefficient (k1) based on a degree of deterioration of the photoconductive member:

$$Pcln=k1\times Vch-k2\times Itr.$$

2. The image forming apparatus according to claim 1, wherein the controller controls the cleaning bias at the cleaning position so that the difference in potential between the photoconductive member and the cleaning roller is within a predetermined range.

3. The image forming apparatus according to claim 1, wherein the controller controls the transferring bias by changing the target current to have a greater value when a length of the sheet in a width direction is relatively shorter than a value of the target current value when the length of the sheet in a width direction is relatively long.

4. The image forming apparatus according to claim 1, further comprising a humidity sensor configured to detect humidity inside a housing of the image forming apparatus, wherein the controller changes the target current to have a higher value when the humidity is relatively low relative to the target current when the humidity is relatively high.

5. The image forming apparatus according to claim 1, further comprising a temperature sensor configured to detect temperature inside a housing of the image forming apparatus, wherein the controller changes the charging bias to have a greater absolute value when the temperature is relatively low relative to the charging bias when the temperature is relatively high.

6. The image forming apparatus according to claim 1, wherein, when the controller controls the cleaning bias, the controller compensates for at least one of the charge potential and the transferring current, which are used to calculate the cleaning position potential, based on the electrical characteristic of the photoconductive member.

7. The image forming apparatus according to claim 1, wherein, when the controller controls the cleaning bias, the controller compensates for the charge potential which is used to calculate the cleaning position potential based on a degree of deterioration of the photoconductive member.

8. The image forming apparatus according to claim 1, further comprising:

a second photoconductive member;

a second charging device configured to apply a charging bias to the second photoconductive member to charge a surface of the photoconductive member;

a second exposing device configured to expose the surface of the second photoconductive member to light to form an electrostatic latent image on the second photoconductive member;

a second developing device configured to supply second developing agent which has a color different from the developing agent, onto the electrostatic latent image formed on the second photoconductive member to form a second developed image; and a second transferring member configured to be applied with a transferring bias, the second developed image on the second photoconductive member being transferred on the sheet conveyed between the second photoconductive member and the second transferring member by the transferring bias, wherein the image forming apparatus has:

a first mode in which the developed image is formed on the photoconductive member and the second developed image is formed on the second photoconductive member, the developed image and the second developed image being transferred on the sheet; and a second mode in which only the second developed image is formed and transferred on the sheet, wherein the controller controls the second charging device such that the absolute value of the charging bias when the image forming apparatus operates in the second mode is smaller than the absolute value of the charging bias when the image forming apparatus operates in the first mode.

9. The image forming apparatus according to claim 8, further comprising a second cleaning member arranged to face the second photoconductive member at a second cleaning position, the second cleaning member being configured to be applied with a cleaning bias to collect residual second developing agent on the second photoconductive member after the second developed image is transferred, wherein the controller controls the transferring bias applied to the second transferring member so that a transferring current representing a current flowing between the second photoconductive member and the second transferring member has a target current value, and wherein the controller calculates a second cleaning position potential representing a surface potential of the second photoconductive member at the second cleaning position based on the transferring current and a charge potential representing a surface potential of the second photoconductive member immediately after being charged by the second charging device, and controls the cleaning bias applied to the second cleaning member based on the second cleaning position potential as calculated.

* * * * *